US007637372B2

(12) United States Patent
Keel et al.

(10) Patent No.: US 7,637,372 B2
(45) Date of Patent: Dec. 29, 2009

(54) HYBRID SHOPPABLE PALLET DISPLAY

(75) Inventors: Donald Wayne Keel, Flower Mound, TX (US); Garrett William Kohl, Allen, TX (US); David Charlton McFadden, III, Flower Mound, TX (US)

(73) Assignee: Frito-Lay North America, Inc., Plano, TX (US)

( * ) Notice: Subject to any disclaimer, the term of this patent is extended or adjusted under 35 U.S.C. 154(b) by 784 days.

(21) Appl. No.: 11/184,943

(22) Filed: Jul. 19, 2005

(65) Prior Publication Data

US 2007/0017843 A1 Jan. 25, 2007

(51) Int. Cl.
*B65D 5/28* (2006.01)
*B65D 21/00* (2006.01)

(52) U.S. Cl. ..... 206/509; 206/511

(58) Field of Classification Search ..... 206/600, 206/736, 766–768, 774, 509, 511, 512, 386, 206/769, 782; 229/915, 918, 919
See application file for complete search history.

(56) References Cited

U.S. PATENT DOCUMENTS

| | | | | | |
|---|---|---|---|---|---|
| 2,152,079 | A | | 3/1939 | Mott | |
| 2,986,320 | A | * | 5/1961 | Nicholls et al. | 229/191 |
| 3,315,875 | A | | 4/1967 | Praetorius et al. | |
| 4,000,811 | A | | 1/1977 | Hardison et al. | |
| 4,151,948 | A | * | 5/1979 | de la Fuente, Jr. | 206/512 |
| 5,052,615 | A | | 10/1991 | Ott et al. | |
| 5,487,505 | A | * | 1/1996 | Nilsson | 229/191 |
| 5,535,941 | A | * | 7/1996 | Garza | 229/191 |
| 5,826,728 | A | | 10/1998 | Sheffer | |
| 5,913,474 | A | * | 6/1999 | Chu | 229/167 |
| 6,152,305 | A | * | 11/2000 | Green | 206/764 |
| 6,227,370 | B1 | * | 5/2001 | Earnshaw et al. | 206/497 |
| 6,267,255 | B1 | * | 7/2001 | Brush | 211/59.4 |
| 6,270,007 | B1 | | 8/2001 | Jensen, Jr. | |
| 6,405,921 | B1 | * | 6/2002 | Cochrane | 229/242 |
| 6,488,200 | B1 | | 12/2002 | Jensen, Jr. | |
| 6,513,705 | B1 | * | 2/2003 | Sheffer | 229/178 |
| 6,712,214 | B1 | * | 3/2004 | Wintermute et al. | 206/745 |
| 7,066,342 | B2 | * | 6/2006 | Baechle et al. | 211/191 |
| 2003/0150764 | A1 | * | 8/2003 | Bevier | 206/509 |
| 2004/0124111 | A1 | * | 7/2004 | Bevier | 206/509 |
| 2006/0249565 | A1 | * | 11/2006 | Wood et al. | 229/164 |

FOREIGN PATENT DOCUMENTS

| | | | |
|---|---|---|---|
| WO | WO02/18227 | A1 | 3/2002 |
| WO | WO02/102672 | A1 | 12/2002 |

* cited by examiner

*Primary Examiner*—Ehud Gartenberg
*Assistant Examiner*—King M Chu
(74) *Attorney, Agent, or Firm*—Colin P. Cahoon; Carstens & Cahoon, LLP

(57) ABSTRACT

A stackable display case for protecting products which are unable to support a compressive load. Such display case provides improved protection of products during shipping and sale. Such display cases are loaded with products, stacked three or more cases high, two per layer, on a pallet at a production facility before being shipped to warehouse style and other retail outlets. Such display cases allow products to be sold directly from pallets and require a minimal amount of manual labor compared to prior art shipping displays. Such display case provides visibility and accessibility from four sides of pallets, and from at least three sides of each display case. Such a display case requires substantially less manual labor at a manufacturing and shipping facility, and almost no manual labor at the point of sale.

8 Claims, 4 Drawing Sheets

HYBRID SHOPPABLE PALLET DISPLAY

BACKGROUND OF THE INVENTION

1. Technical Field

The present invention relates generally to a stackable display case for sale of retail products. More specifically, the invention relates to stackable one-piece open top display cases which may be filled, stacked on pallets, and wrapped before shipping them to warehouse retail outlets. Such display cases provide visibility and accessibility from four sides of pallets.

2. Description of Related Art

Millions of dollars are spent each year in packaging products for transportation from manufacturers to retail outlets. Rather than require these products to be removed from containers and individually placed on shelves in a store front, it has long been desirable to ship and sell products directly from pallets. Member-only warehouse clubs provide the buying public, including private individuals and businesses, price savings by selling goods directly from pallets. Club stores often display their goods as delivered from suppliers on shipping pallets and thus reduce their costs by eliminating the labor of unpacking goods from pallets and displaying them for purchasers. Club stores often prefer to deal with suppliers who ship their goods on pallets.

Costs are also reduced by modifying the types and amounts of packaging associated with retail products. However, some products do not easily survive undamaged while being shipped on pallets to retail establishments, especially products which cannot bear compressive loads such as plants, gift baskets, lamps, buckets of cut flowers, stuffed animals, and bags of snack products. These products routinely require special packaging and significant manual labor for retail sale even if sold from pallets. Many packing schemes and packages have been invented to solve the problems associated with getting such products undamaged to consumers while still allowing consumers to easily view and select products.

One solution to this frequent problem has been to ship products in stackable trays or cartons, each comprising several components. FIG. 1 shows an overhead view of a composite of various features and components of trays according to the prior art. With reference to FIG. 1, a prior art tray or carton 102 may have a vertical stacking tab or cleat 104 rising above the top plane of each tray or carton 102. Such tab 104 locks into a corresponding opening (not shown) in the tray 102 stacked above it. Alternatively, a prior art tray 102 may have a foldable glued flap 106 which overlays each corner and is secured to the tray's side by glue, adhesive or other means. Such flaps 106 provide increased strength and support for a compressive load of stacked trays and further protect the goods inside each tray 102. Such foldable flaps 106 may be overly complex to assemble, may not be suitable for trays containing certain products, or may require excessive manual labor.

Another existing alternative is to fold a flap 108 at a corner and lock it onto a tab 110 of a separate strengthening insert 114. A receiving opening 112 in the bottom surface near each corner accepts an insert's tab 110 which protrudes from the top plane of each tray 102. When each insert's tab 110 is interlocked into a receiving opening 112, each tray 102 is less likely to move horizontally relative to another tray 102 and damage the contents of the tray below it. Additional inserts 114 require additional manual labor at assembly.

Yet another existing strengthening means is to insert a top-mounted removable foldable corner insert 118 into each corner of a tray 102. Such removable corner insert 118 may fold over the outside of a tray 102, or may reside completely within a tray 102. One style of free corner insert 120 has a single fold and sits squarely inside each corner. Such a free corner insert 120 may provide some additional strength against compressive loads to a tray, but does not contribute to a container which is substantially open for displaying the contained goods.

In general, assembly, shipping, displaying, and sale of certain products from stackable trays or cartons is complex, and may require substantial manual labor at the point of sale for proper display of such goods, especially where such goods are sold from pallets. With reference to FIG. 1, many trays and cartons have foldable sides 116 which form openings for easily viewing of enclosed goods. Some foldable sides 116 are secured in place by inserting tabs 122 in corresponding openings along side creases 124. Many trays also have openings which serve as carrying handles 126 for convenience. Such openings 126 do not provide sufficient visibility of enclosed goods.

Several patents disclose other improvements to cartons, crates and trays for bundling, shipping, and selling products which cannot support a compressive load. For example, U.S. Pat. No. 2,152,079 issued to Mott on Mar. 28, 1939 discloses a combination shipping and display carton. After shipping, a perforated section of the package may be removed for display and sale of individual packaged units within the carton. Even though this invention provides a means to stack bundles of individual units, this invention requires manual labor to modify each container to allow for sale of individual units contained within the packages.

U.S. Pat. No. 3,315,875 issued to Praetorius on Apr. 25, 1967 discloses a similar concept in that a side panel may be removed exposing individual units for sale. Likewise, U.S. Pat. No. 4,000,811 issued to Hardison et al., and U.S. Pat. No. 5,826,728 to Sheffer disclose a convertible carton which provides protection for its contents during shipping, and which subsequently may be transformed into an aesthetically pleasing display carton. These inventions may solve alignment and shipping problems, but require substantial manual labor prior to final display and sale of goods even though such packages may be stacked and shipped on pallets. These cartons are not folded from a single blank.

U.S. Pat. No. 5,052,615 issued to Ott et al. on Oct. 1, 1991 discloses a stackable carton or tray for a single layer of tomatoes. This invention requires separate reinforcing members inserted into tray corners so as to bear the load of other trays; these trays are not formed from a single folded paperboard blank.

U.S. Pat. No. 6,712,214 issued to Wintermute et al. on Mar. 30, 2004 discloses a stackable display tray which is similarly formed from a blank and multiple additional inserts. Portions of the blank are folded up to create sides and reinforced corners for a multi-sided tray or shell. Angular panels are positioned inside the tray to provide increased stability and support.

U.S. Pat. No. 6,270,007 and U.S. Pat. No. 6,488,200 issued to Jensen, Jr., and International Patent Application PCT/US01/26610 disclose an improved crate for stacking and shipping plants. It discloses a crate system consisting of a bottom cap, crate walls, and a top cap. The bottom and top caps are the same size and shape, and are interchangeable. Goods inside the crate are protected from compressive loads, and the crates can be stacked several crates deep. In this invention, the corners and bottom sections are not formed from the same blank. It would be more ideal to have a shipping container comprised of just a bottom and support walls thus eliminating the need for a top piece for every container, tray or carton.

Published International Patent Application PCT/US02/19025 entitled "Stackable Display Container" by Holdsworth, et al., discloses a stackable display container which may be formed from a single blank, shipped flat and assembled without adhesive. Such container has stacking shoulders and reinforced corners. This invention is only open on two sides wherein the other two sides are designed for handles.

None of these inventions adequately solves the problems associated with transporting and selling goods which are sensitive to compressive loads, these goods being sold directly from pallets. Consequently, a need exists for a carton, tray, or display which is easily stackable, and which remains stacked on a pallet in columns during shipping. A need exists for a shipping display which can be easily assembled at a production facility, and which can be used for the sale of goods as initially shipped and displayed on a pallet. A further need exists for a display which can be easily assembled from a single display blank and which has few or no additional parts required for shipping. A further need exists for a tray which may be stacked in columns and shipped on pallets, which allows the contents of the carton or tray to be seen, and which requires little or no additional manual labor for the goods to be sold from pallets. The present invention fills these and other needs as detailed more fully below.

SUMMARY OF THE INVENTION

A stackable display case allows products which are unable to support a compressive load to reach consumers for retail purchase substantially unharmed. Such display cases are loaded with products, stacked several layers deep, two per layer, on a pallet at a manufacturing facility before being shipped to warehouse style retail outlets. Such display cases allow products to be sold directly from pallets and require a minimal amount of manual labor compared to prior art shipping packages. Such display cases provide visibility and accessibility from four sides of pallets, and from three or four sides of each display case. Such a display case requires substantially less manual labor at a manufacturing and shipping facility, and almost no manual labor at the point of sale.

The invention accordingly comprises the features described more fully below, and the scope of the invention will be indicated in the claims. Further objects of the present invention will become apparent in the following detailed description.

BRIEF DESCRIPTION OF THE DRAWINGS

The novel features characteristic of the invention are set forth in the appended claims. The invention as well as a preferred mode of use, further objectives and advantages thereof, will be best understood by reference to the following detailed description of illustrative embodiments when read in conjunction with the accompanying drawings, wherein:

REFERENCE NUMERALS

Figure 1:
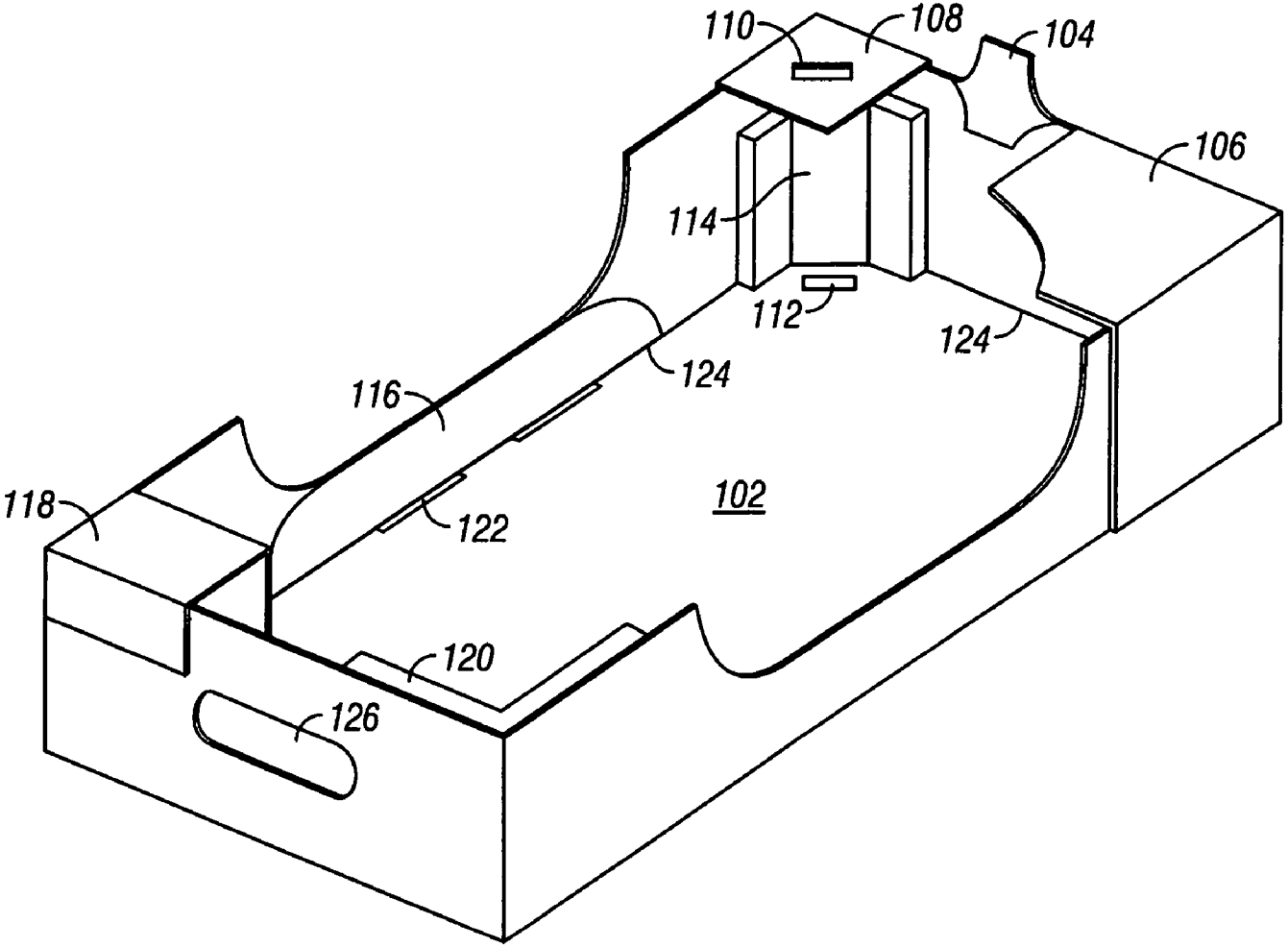
FIG. 1 shows a perspective view of a tray having a variety of prior art elements which serve to strengthen the tray against compression loads.

102 product tray
104 vertical stacking tab or cleat
106 foldable glued flap
108 corner flap with opening for stacking tab
110 vertical tab of strengthening insert
112 receiving opening for stacking tab
114 strengthening insert
116 foldable side flap
118 top-mounted removable foldable corner insert
120 free corner insert
122 tab on foldable side flap
124 side crease
126 carrying handle
202 bottom panel
204 back panel
206 post panel tab
208 side panel attached to back panel
210 front panel flap
212 panel flap slot
214 panel flap tab
216 front panel
218 crease line
220 first post panel
222 second post panel
224 third post panel
226 interlocking top tab
228 three dimensional vertical support post
230 side panel flap
232 top tab receiving opening
236 lower side panel
238 short side support post width
240 long side support post width
242 side or front panel height
302 bag or product package
304 positioning insert
306 protective corner piece
310 protective shipping lid
312 side opening
314 front opening
316 first tier of hybrid shoppable pallet displays
318 second tier of hybrid shoppable pallet displays
320 pallet

DETAILED DESCRIPTION

While the invention is described below with respect to a preferred embodiment, other embodiments are possible. The concepts disclosed herein apply equally to other stackable product display cases for selling products from pallets and other containers, especially those display cases with substantially vertical sides and an open top for protection and display of products which alone cannot support a compression load. The invention is described below with reference to the accompanying figures.

Figure 2A:
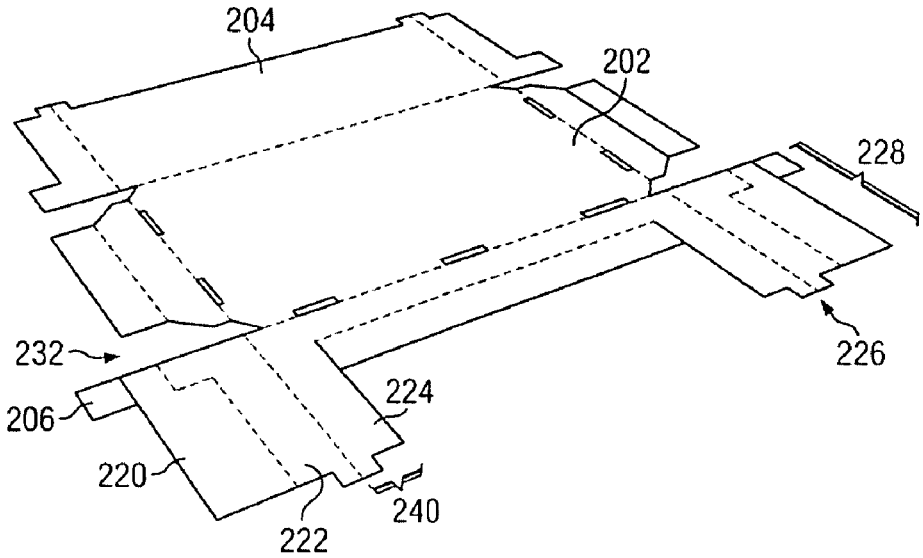
FIG. 2A shows a perspective view of a flat corrugated display blank according to the present invention prior to being assembled into a hybrid shoppable pallet display.
Figure 2B:
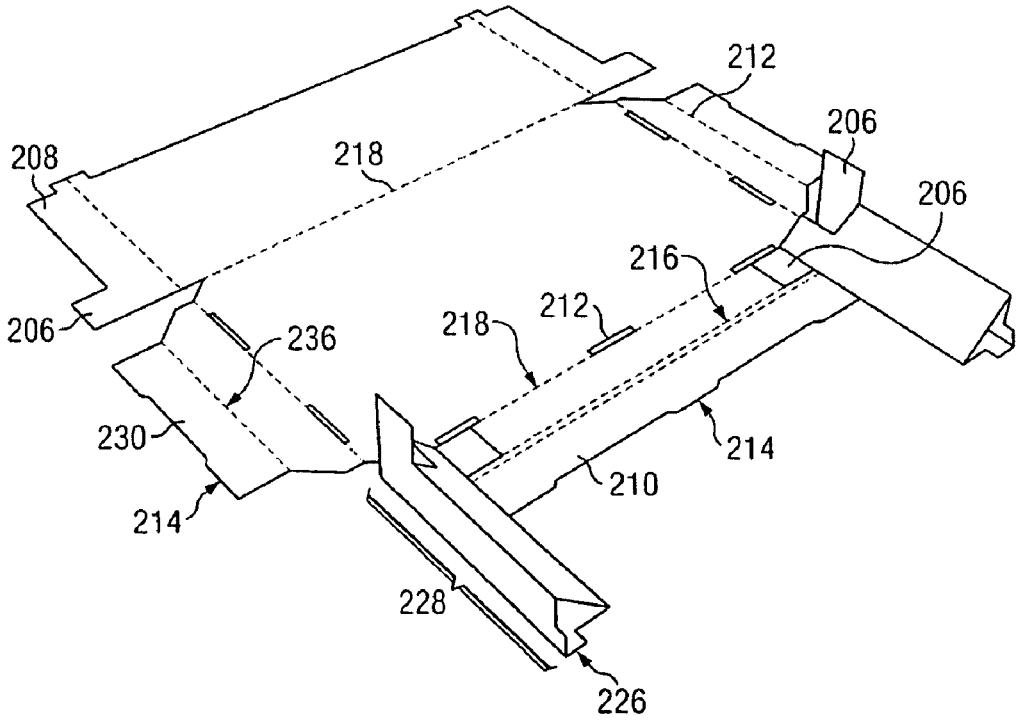
FIG. 2B shows a perspective view of a corrugated display according to the present invention after front posts have been assembled.
Figure 2C:
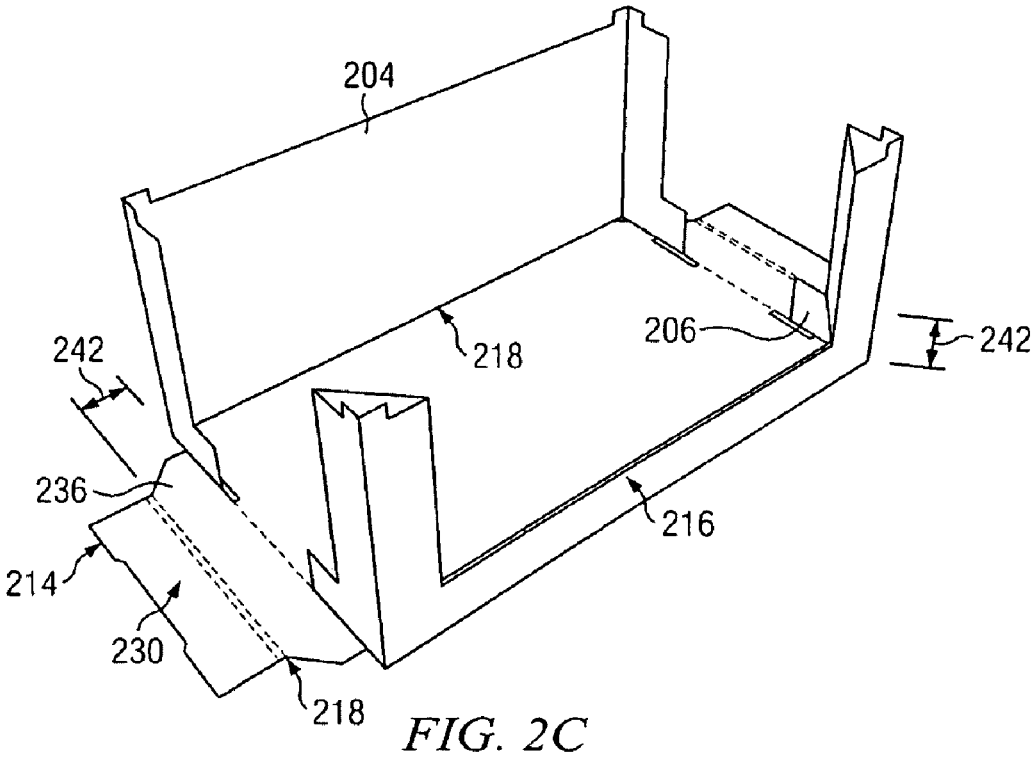
FIG. 2C shows a perspective view of a corrugated display according to the present invention after the front roll-over panel has been assembled the support stays of the front posts, front and rear sides have been uprighted, and side wings have been folded into proper position.
Figure 2D:
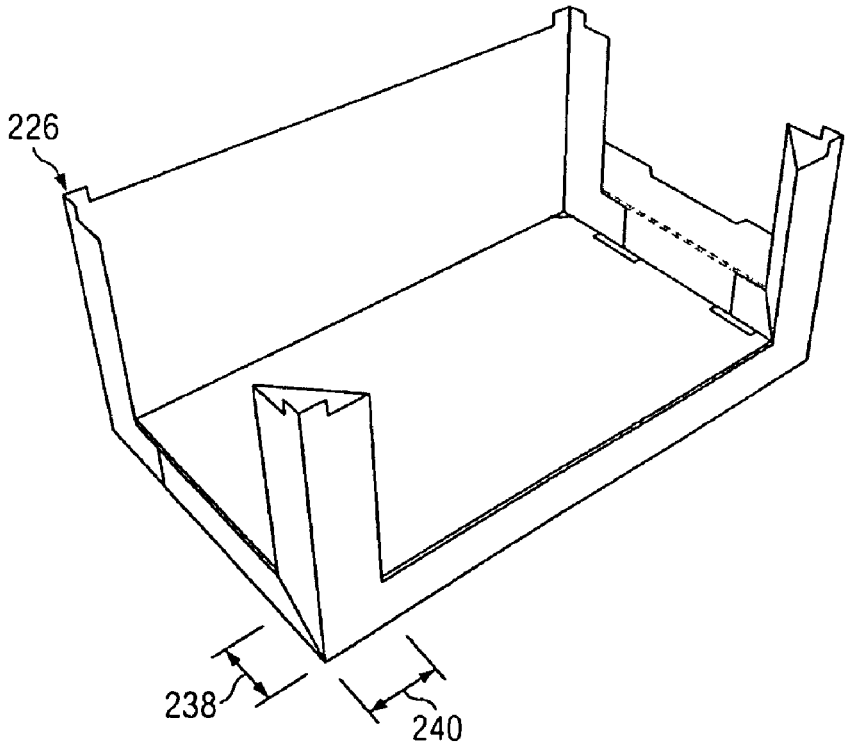
FIG. 2D shows a perspective view of a nearly assembled corrugated display according to the present invention after the side panel roll-overs have been assembled over the side wings.

According to a preferred embodiment, FIG. 2A through FIG. 2D show perspective views of a hybrid shoppable pallet display in various stages of assembly. FIG. 2D shows a nearly assembled hybrid shoppable pallet display which is formed from a single flat display blank such as the one shown in FIG. 2A. With a minimal number of steps, a finished display may be assembled quickly and easily prior to use. In one embodiment, no adhesive is required for complete assembly of such display. The one piece design provides increased efficiency and higher production rates at the point of packaging than previously possible.

With reference to FIG. 2A, the first step for assembly is to form three dimensional vertical support posts 228. For each post, a first post panel 220 is folded along a crease line 218 over a third post panel 224 whereby a first post panel tab 206 is lying flat against a front panel 216, and whereby a second post panel 222 and an attached second post panel tab 206 lie substantially perpendicular to the plane of the flat unassembled display blank. The result of this first step is shown in FIG. 2B.

With reference to FIG. 2B, the next step is to fold one front panel flap 210 over the front panel 216. A panel flap 210 and a panel 216 together may be considered a rollover panel. Each front panel flap 210 may have one or more flap tabs 214. Front panel flap tabs 214 are formed in the display blank so as to fit snuggly in slots 212 which are formed in corresponding and appropriate places along a folding crease 218 along the base of the front panel 216. Folding creases 218 may be perforated to assist in assembly, opening or destruction of displays. The front panel flap 210 is folded over and secures the post panel tabs 206 of the vertical posts 228. These post panel tabs 206 so secured help provide the necessary stability, strength, and shape of the vertical posts 228. At the top of each support post 228, there is at least one interlocking top tab 226. In a preferred embodiment, an interlocking top tab 226 is formed at a crease line between a second panel 222 and a third panel 224 such that upon forming a support post 228, parts of each interlocking top tab 226 are perpendicular to each other. Such V-shaped interlocking top tab 226 fits adroitly within a top tab receiving opening 232 formed in the bottom of each support post 228 due to the contouring of each lower side panel 236 and side panel flap 230.

With reference to FIG. 2C, there is a top tab receiving opening 232 in each of the corners of the bottom panel 202 of the display. The next step of the assembly process is to fold the back panel 204 and front panel 216 to a vertical or perpendicular position relative to a bottom panel 202. Support posts 228 form part of a front panel 216. Subsequently, side panel flaps 230 are folded over the top of a second set of panel tabs 206 attached to or forming part of the support posts 228. This second set of panel tabs 206 lie parallel to the sides of the pallet display. The side panel flaps 230 are simultaneously folded over panel tabs 206 which form part of side panels 208, the side panels 208 being hingedly attached to the back panel 204. The side panel flaps 230 are likewise secured by flap tabs 214 inserted snuggly into slots 212. The panel tabs 206 so secured provide the necessary support, strength and stability to the back panel 204 and support posts 228. The back panel 204 and support posts 228 are designed to bear vertical compression loads. Such compression loads include, but are not limited to, several hybrid shoppable pallet displays loaded with products stacked one above another in columns on a pallet. In an alternative embodiment, front panel crease lines 218 and side panel crease lines 218 may be comprised of two narrowly separated perforated crease lines so as to adroitly facilitate the folding of panel flaps 210, 230 over panel tabs 206.

A nearly assembled hybrid shoppable pallet display is shown in FIG. 2D. The vertical posts 228 provide support for compressive loads while simultaneously allowing substantial visibility of products within the display. A front side width 240 and short side width 238 of each vertical support post 228 are selected so as to provide an optimal amount of strength to each vertical support post 228 even when another display or other large item is stacked on top of it. The size of each front side width 240 and each short side width 238 of each post 228 is a compromise between providing maximum visibility (large open sides) of the interior of the display and providing adequate strength to support compressive loads associated with stacking identical or similar displays on top of one another on a pallet. The height 242 of the lower side panels 236 and front panels 216 is likewise a compromise between providing maximum visibility to products within the display and providing sufficient strength to the display and protection to the products. The height 242 of the side panels 236 is not required to be the same as the height 242 of the front panels 216.

Figure 3A:
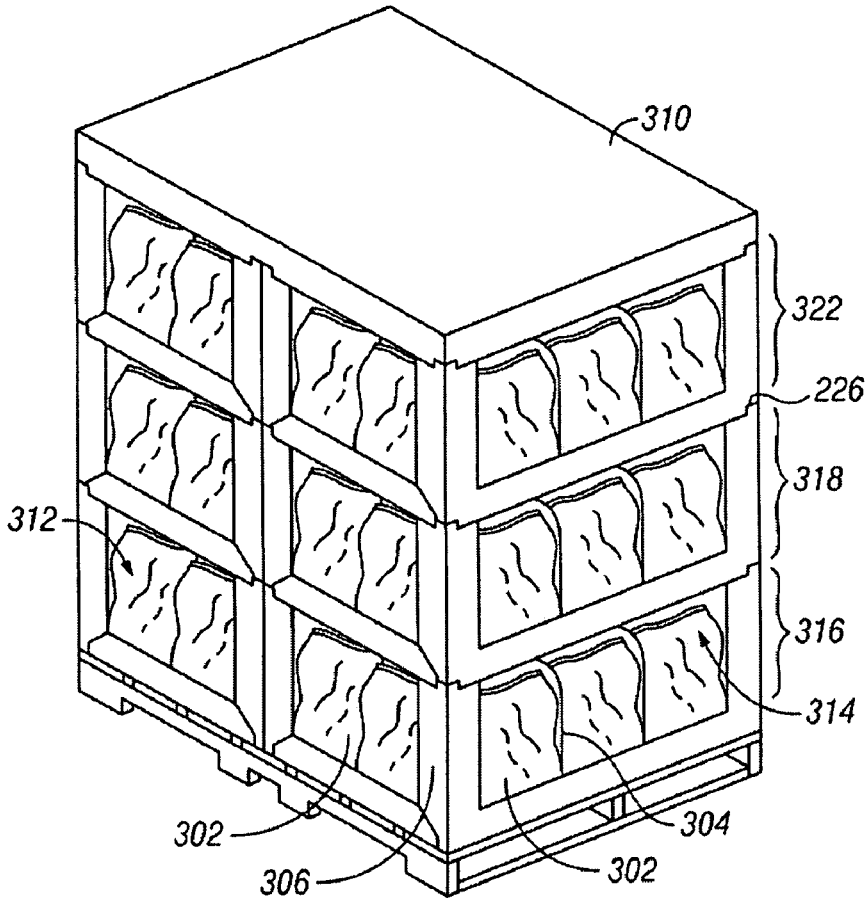
FIG. 3A shows a side perspective view of four layers of hybrid shoppable pallet displays according to the present invention assembled on a pallet and ready for shipment to a retail outlet, such assembly having protective corner coverings, a protective lid and shrink-wrapped plastic which stabilizes the product inside the pallet assembly; and, FIG. 3B shows an overhead view of one hybrid shoppable pallet display wherein strengthening inserts have been added to provide additional strength against compression loads according to one embodiment of the present invention.

FIG. 3A shows in a perspective view three layers 316, 318, 322 of hybrid shoppable pallet displays stacked back to back on a pallet 320 according to one embodiment of the invention. Other numbers of layers are possible. At the top of a completed pallet 320 there is a protective shipping lid 310 which may be removed at the point of sale. Protective corner pieces 306 also may be placed on the corners of pallet displays before wrapping the loaded pallet 320 with plastic as is common in the industry for shipping purposes.

A completed pallet is formed by manually stacking each display on top of one another after each display is loaded with products 302. Each interlocking top tab 226 of each support post 228 and back panel 204 is fit into a corresponding top tab receiving opening (not shown) which is aligned directly above each tab 226. Such interlocking provides support and stability against horizontal forces during shipping and handling which tend to misalign columns of prior stacked displays, cartons or boxes.

Since the backs 204 of the hybrid shoppable pallet displays are in the center of the pallet, the remaining open three sides of each hybrid shoppable pallet display provide access and visibility to products 302 from four sides of a pallet 320. Specifically, side openings 312 and front openings 314 allow consumers to view, select and remove products 302. The maximum visibility provided by the hybrid shoppable displays allows consumers to see as much of the printing of the product packaging as possible. FIG. 3A shows products 302 facing one direction: toward a long side opening 314. However, some products 302 may alternatively be faced toward a short side opening 312. In this way, the front of products 302 may be visible from four sides of a loaded pallet 320. Providing such high visibility of products 302 is desirable for marketing purposes. The front panels 216, lower side panels 236, back panels 204, and support posts 228 may be printed with marketing or other designs or information.

As products 302 are depleted from a top layer 322, empty hybrid shoppable pallet displays may be removed thus providing increased visibility to products 302 in the next lower layer 318. This process may be repeated until the remaining layers 316 and 318 end are depleted.

Figure 3B:
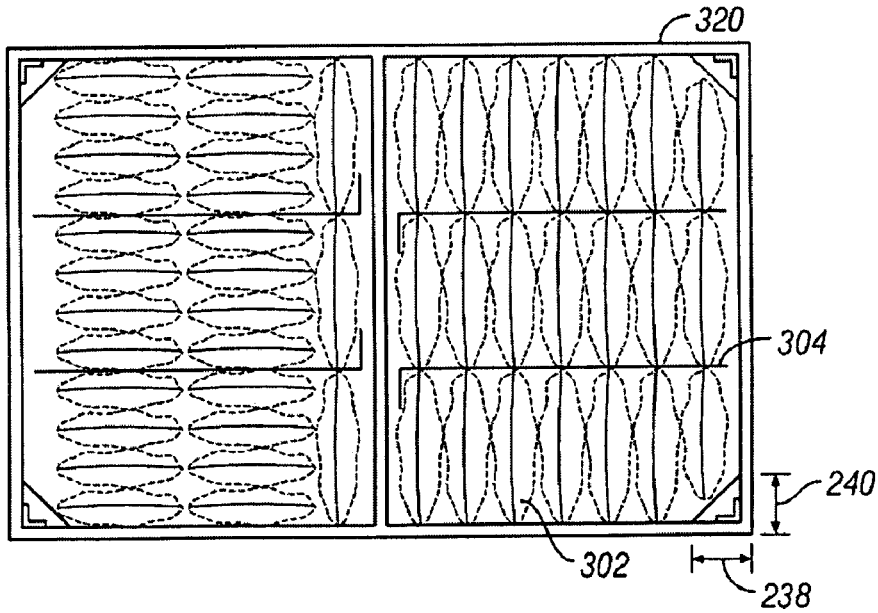

Optionally, positioning inserts 304 may be placed between rows of products 302 within each display. Such positioning inserts 304 laterally support and align products 302 and protect products from moving excessively within a shoppable display. The corners of positioning inserts 304 may be rounded so as to increase the likelihood that positioning inserts remain properly placed and oriented. Additionally, positioning inserts 304 may provide, but are not required for, support against vertical compression loads. With reference to FIG. 3B, in one embodiment, positioning inserts 304 may be formed with a single crease in an "L" shape. Other shapes and orientations are possible.

In one embodiment, a hybrid shoppable pallet display is designed to fit onto half of a standard shipping pallet of size 48 inches by 40 inches (122 cm by 102 cm). Such pallet size corresponds to a hybrid shoppable pallet display of size 40 inches (102 cm) along the front by 23 and ¾ inches (60 cm) along its short side. In a preferred embodiment, the height of a hybrid shoppable pallet display is from 15 inches (38 cm) to 18 inches (46 cm) in height. Other heights are possible where such display height conforms to the height of products within the display. The height 242 of the lower side panels 236 and front panels 216 is preferably about three and one half inches (9 cm) but other heights greater or smaller are possible.

In shipping tests with hybrid shoppable pallet displays having three open sides, there were zero refused shipments due to damaged products. In an alternative embodiment, a hybrid shoppable pallet display is build with at least four vertical support posts 228. In such an embodiment, a hybrid shoppable pallet display has openings in all four sides. With reference to FIG. 2B, in such embodiment, in place of a back panel 204, two additional vertical support posts 228 are formed along the back portion of the display blank. In such embodiment, products are visible from all four sides.

Those skilled in the art recognize that other variations and configurations of the components of a hybrid shoppable pallet display are possible. For example, in an alternative embodiment, a hybrid shoppable pallet display only uses a single post panel tab 206 for each vertical support post 228. In a further alternative embodiment, there may be four or more vertical support posts 228 per hybrid shoppable pallet display. In a further alternative embodiment, there may be multiple interlocking top tabs 226 for each vertical support post 228. In yet a further alternative embodiment, portions of a hybrid shoppable pallet display may be detached or separated from the paperboard blank before complete assembly of the hybrid shoppable pallet display. In another alternative embodiment, a positioning insert may be folded from the paperboard blank used to create the hybrid shoppable pallet display.

The foregoing discussion of the invention has been presented for purposes of illustration and description. One of ordinary skill in the art will recognize that one can modify the dimensions and particulars of the display, as well as the specific design of the crease lines, and other display features, without straying from the inventive concepts. The description is not intended to limit the invention to the forms disclosed herein. Consequently, variation and modification commensurate with the above teachings, within the skill and knowledge of the relevant art, are within the scope of the present invention. A preferred embodiment described herein is further intended to explain the best mode presently known of practicing the invention and to enable others skilled in the art to utilize the invention. It is intended that the appended claims be construed to include alternate embodiments to the extent permitted.

We claim:

1. A folded display formed from a single blank of a suitable sheet material, comprising:

a central floor;

a back panel;

a front rollover panel, wherein said front rollover panel comprises a front panel flap folded over a front panel;

a left side rollover panel;

a right side rollover panel;

two side panels hingedly attached to said back panel wherein each side panel has a panel tab, further wherein each panel tab is foldably enclosed by at least one of said side rollover panels; and at least two vertical support posts wherein each support post is folded from a section of the blank, said section of the blank comprising an inner post panel, an intermediate post panel, and an outer post panel, said intermediate panel having a support tab foldably enclosed by the side rollover panel, said outer panel having a support tab foldably enclosed by said front rollover panel, further wherein each vertical support post has an interlocking top tab, and further wherein the blank is formed with at least one top tab receiving opening for each interlocking top tab.

2. The folded display of claim 1 wherein the folded display is open on at least three sides when stacked on a pallet.

3. The folded display of claim 1 wherein the vertical support posts are folded from at least three hingedly attached panels of said blank.

4. The folded display of claim 1 wherein each of the vertical support posts have a triangular cross section.

5. The folded display of claim 1 wherein a front side has a length of about 40 inches (102 cm) and a short side has a length of about 23 and ¾ inches (60 cm).

6. The folded display of claim 1 wherein the height of said folded display is from about 4 inches (10 cm) to about 100 inches (254 cm) in height.

7. The folded display of claim 1 wherein the height of said folded display is from about 15 inches (38 cm) to about 18 inches (46 cm) in height.

8. A pallet display system comprising:

a plurality of hybrid shoppable pallet displays stacked at least two per layer in plurality of layers on a pallet wherein each display is comprised of:

a front rollover panel, wherein said front rollover panel comprises a front panel flap folded over a front panel;

a left side rollover panel;

a right side rollover panel; and, at least two vertical support posts wherein each support post is folded from a section of the blank, said section of the blank comprising an inner post panel, an intermediate post panel, and an outer post panel, said intermediate panel having a support tab foldably enclosed by the side rollover panel, said outer panel having a support tab foldably enclosed by said front rollover panel, further wherein each vertical support post has an interlocking top tab, and further wherein the blank is formed with at least one top tab receiving opening for each interlocking top tab.

* * * * *